United States Patent [19]

Suzuki et al.

[11] 4,454,846

[45] Jun. 19, 1984

[54] METHOD AND APPARATUS FOR CONTROLLING THE AIR-FUEL RATIO IN AN INTERNAL-COMBUSTION ENGINE

[75] Inventors: Yukio Suzuki; Yoshihiko Matsuda, both of Toyota, Japan

[73] Assignee: Toyota Jidosha Kabushiki Kaisha, Toyota, Japan

[21] Appl. No.: 506,374

[22] Filed: Jun. 21, 1983

[30] Foreign Application Priority Data

Mar. 22, 1983 [JP] Japan ..... 58-46037

[51] Int. Cl.[3] ..... F02B 3/00

[52] U.S. Cl. ..... 123/489; 123/440

[58] Field of Search ..... 123/440, 489, 493

[56] References Cited

U.S. PATENT DOCUMENTS 4,129,105 12/1978 Ito ..... 123/440

4,136,645 1/1979 Ito ..... 123/440

*Primary Examiner*—Ronald B. Cox

*Attorney, Agent, or Firm*—Cushman, Darby & Cushman

[57] ABSTRACT

In an internal-combustion engine disposed in a vehicle, when the engine is in an idle state and the vehicle speed is not equal to zero and is less than a predetermined value, the air-fuel ratio of the engine is controlled so that the air-fuel mixture is on the lean side of the stoichiometric air-fuel ratio. In addition, even after the vehicle speed becomes zero, the air-fuel ratio is controlled so that the air-fuel mixture is on the lean side for a predetermined time period.

12 Claims, 15 Drawing Figures

IN
401
LL = 1 ?
NO
YES
402
SPD < V1 ?
NO
YES
403
SPD ≠ 0 ?
NO
YES
404
F ← 0
405
F = 0 ?
NO
YES
406
Nt ← 0
F ← 1
407
409
Nt < No ?
NO
YES
410
λ > 1 CONTROL
411
λ = 1 CONTROL
OUT

METHOD AND APPARATUS FOR CONTROLLING THE AIR-FUEL RATIO IN AN INTERNAL-COMBUSTION ENGINE

BACKGROUND OF THE INVENTION

1. Field of the Invention

The present invention relates to a method and apparatus for feedback control of the air-fuel ratio in an internal-combustion engine by means of a specific component in the exhaust gas.

2. Description of the Prior Art

A prior art feedback (closed loop) controlling method for controlling the air-fuel ratio repeats the following steps so as to control the center value of the air-fuel ratio within a narrow range of air-fuel ratios around the stoichiometric ratio required for a three-way reducing and oxidizing catalytic converter. First, the intake-air amount (or the intake-air pressure) and the running speed of the engine are detected. Then, a base-fuel injection amount to be supplied into fuel injectors are calculated depending upon the detected intake-air amount and the detected engine speed. The base-fuel injection amount is corrected by using an air-fuel compensation factor which is calculated from a detection signal of a concentration sensor ($O_2$ sensor) for detecting the concentration of a specific component such as the oxygen concentration in the exhaust gas of the engine. Thus, the corrected fuel-injection amount determines the actual fuel-feeding rate of the engine. Therefore, since the air-fuel ratio is controlled within a very small range around the stoichiometric ratio, the catalytic converter can maintain its capability at a high level so as to effectively remove three gas-containing pollutants, i.e., carbon monoxide (CO), unburned hydrocarbons (HC), and nitrogen oxide ($NO_x$).

In the above-mentioned air-fuel ratio feedback control method, however, in order to maintain the cleaning capacity of the catalytic converter at a maximum, the air-fuel ratio is controlled depending upon the indication signal of the $O_2$ sensor so as to attain $\lambda$ (air ratio)=1, even during the deceleration mode or the idle mode. As a result, the air-fuel ratio may fluctuate during the deceleration mode, and the air-fuel ratio may shift a little to the rich side during the idle mode. In this case, the atmosphere within the catalytic converter is reduced so that the converter gives out odorous fumes, such as hydrogen sulfide gas, in the exhaust gas.

In order to solve the above-mentioned problem, one approach is to control the air-fuel ratio to satisfy $\lambda>1$ indiscriminately during the deceleration mode and the idle mode, which, however, tends to reduce the driving characteristics, make the engine speed unstable, reduce the capacity of the catalytic converter to clean the emission gas, etc.

SUMMARY OF THE INVENTION

It is an object of the present invention to provide a method and apparatus for feedback control of the air-fuel ratio in which no odorous fumes are given out in the exhaust gas during the deceleration mode and the idle mode.

According to the present invention, when the engine is in an idle state and the vehicle speed is not equal to zero and is lower than a predetermined value, the air-fuel mixture of the engine is controlled so that it is on the lean side of the stoichiometric air-fuel ratio. Furthermore, for a predetermined time period after the vehicle stops, i.e., after the vehicle speed becomes zero, the air-fuel mixture of the engine is also controlled so that it is on the lean side of the stoichiometric air-fuel ratio. As a result, the atmosphere within the catalytic converter is oxidized so as to reduce the amount of odorous fumes in the exhaust gas during the deceleration mode and after the vehicle speed becomes zero.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

Figure 1:
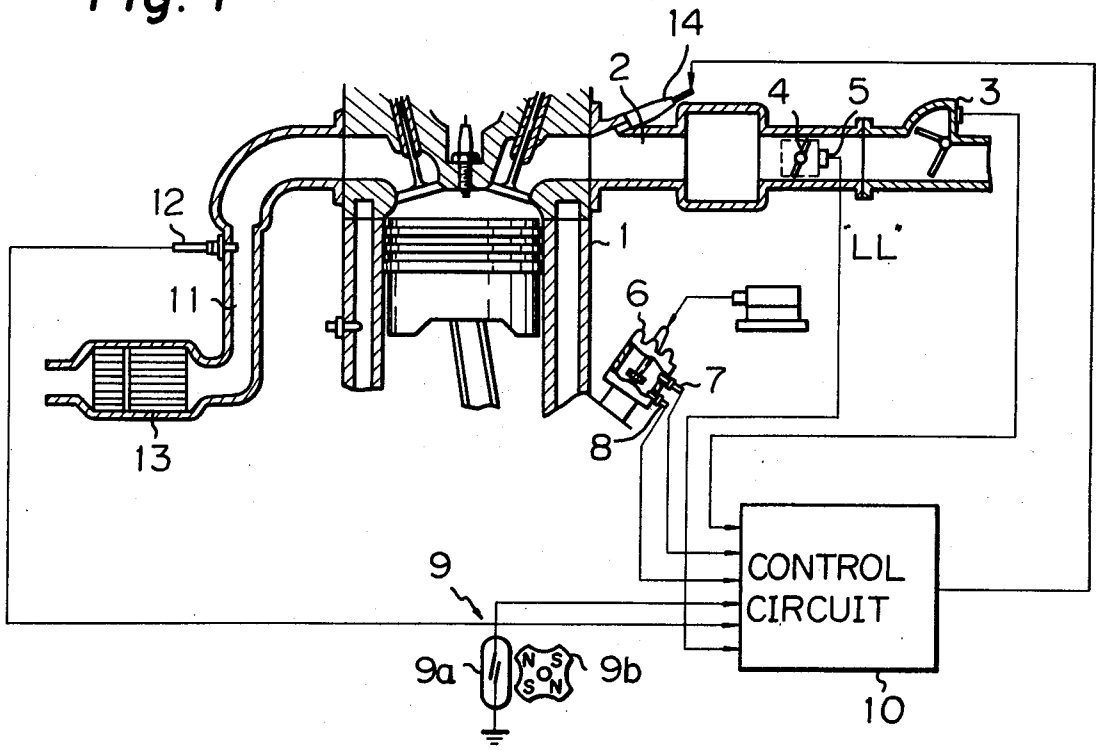
FIG. 1 is a schematic view of an internal-combustion engine according to the present invention.

In FIG. 1, reference numeral 1 designates a four-cycle spark ignition engine disposed in an automotive vehicle. In an intake-air passage 2 of the engine 1, a potentiometer-type airflow meter 3 is provided for detecting the amount of air taken into the engine 1 to generate an analog voltage signal in proportion to the amount of air flowing therethrough. Also provided in the intake-air passage 2 is a throttle valve 4 which has a throttle sensor, i.e., an idle-position switch 5, at the shaft thereof. The idle-position switch 5 detects whether the throttle valve 4 is completely closed, i.e., in an idle position, to generate an idle signal "LL".

Disposed in a distributor 6 are crank-angle sensors 7 and 8 for detecting the angle of the crankshaft (not shown) of the engine 1. In this case, the crank-angle sensor 7 generates a pulse signal at every 720° crank angle (CA) while the crank-angle sensor 8 generates a pulse signal at every 30° CA. The pulse signals of the crank-angle sensors 7 and 8 serve as interrupt-request signals for calculating the fuel-injection pulse duration, the ignition timing, and the like.

Reference numeral 9 designates a vehicle-speed sensor which is comprised of, for example, a lead switch **9*a* and a permanent magnet 9*b*. That is, when the permanent magnet 9*b* is rotated by the speedometer cable (not shown), the lead switch 9*a*** is switched on and off so as to generate a pulse-shaped signal having a frequency in proportion to the vehicle speed.

Disposed in an exhaust passage 11 is an $O_2$ sensor 12 for generating an electrical signal depending upon the oxygen concentration in the exhaust gas. The $O_2$ sensor 12 generates a high-voltage signal (about 1 volt) when the air-fuel ratio in the exhaust gas is less than the stoichiometric air-fuel ratio (i.e., when the air-fuel mixture is on the rich side) and generates a low-voltage signal (about 0.1 volts) when the air-fuel ratio in the exhaust gas is greater than the stoichiometric air-fuel ratio (i.e., when the air-fuel mixture is on the lean side).

Disposed in the exhaust passage 11 on the downstream side of the $O_2$ sensor 12 is a three-way reducing and oxidizing catalyst converter 13 for simultaneously removing three gas-containing pollutants, i.e., CO, HC, and $NO_x$, from the exhaust gas.

Additionally provided in the intake-air passage 2 are fuel injectors 14 for supplying pressed fuel from the fuel system (not shown) to the corresponding intake-air ports of the respective cylinders of the engine 1.

A control circuit 10 responds to the detection signals of the airflow meter 3, the crank-angle sensors 7 and 8, the idle-position switch 5, the vehicle-speed sensor 9, and the $O_2$ sensor 12 to control the injectors 14. Note that such a control circuit 10 is comprised, for example, of a microcomputer.

Figure 2A:
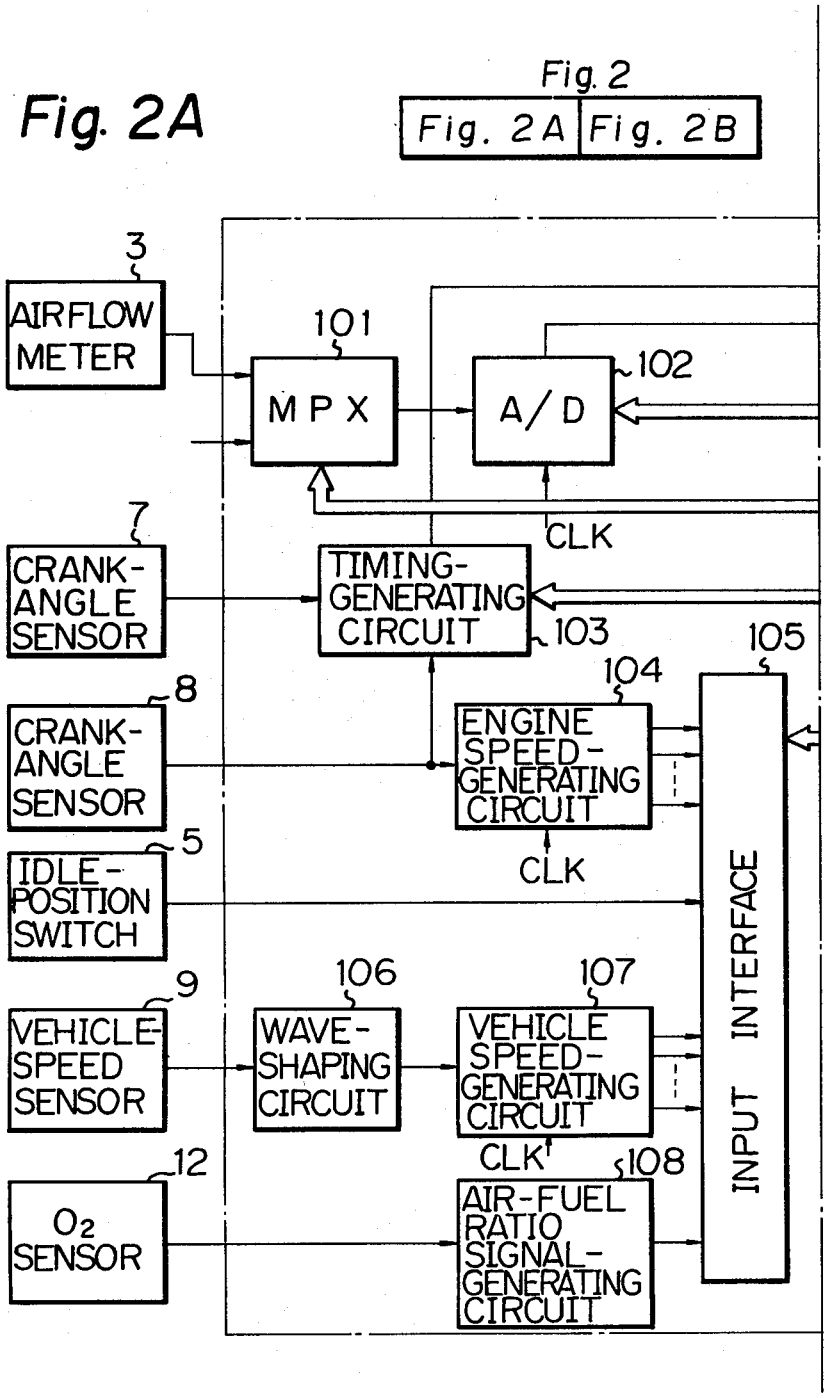
FIGS. 2A and 2B are block diagrams of the control circuit of FIG. 1.
Figure 2B:
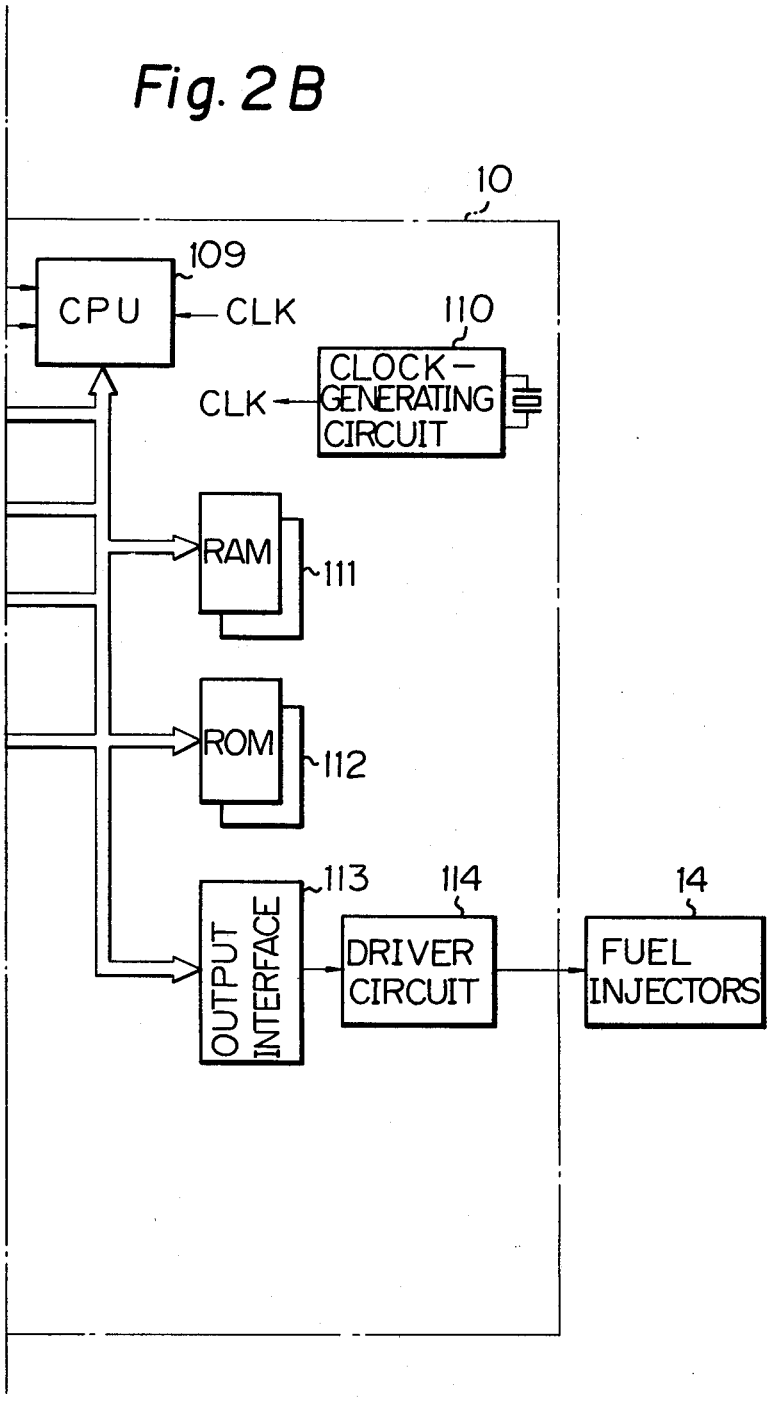

The control circuit 10 is explained in more detail with reference to FIG. 2. In FIG. 2, the analog signal of the airflow meter 3 is supplied via a multiplexer 101 to an analog/digital (A/D) converter 102. That is, the analog signal of the airflow meter 3 is selected by the multiplexer 101, which is controlled by a central processing unit (CPU) 109, and the selected signal is supplied to the A/D converter 102. The A/D converter 102 subjects each analog signal of the airflow meter 3 to A/D conversion by using a clock signal CLK from a clock-generating circuit 110. After each A/D conversion is completed, the A/D converter 102 transmits an interrupt-request signal to the CPU 109. As a result, in an interrupt routine, the CPU 109 successively stores each new piece of data of the airflow meter 3 in a predetermined area of a random-access memory (RAM) 111.

Each digital output signal of the crank-angle sensors 7 and 8 is supplied to a timing-generating circuit 103 for generating interrupt-request signals, reference-timing signals, and the like. The timing-generating circuit 103 comprises a timing counter which counts each pulse signal, generated at every 30° CA, of the crank-angle sensor 8 and is reset by each pulse signal, generated at every 720° CA, of the crank-angle sensor 7. Further, the digital output signal of the crank-angle sensor 8 is supplied via engine speed-generating circuit 104 to predetermined positions of an input interface 105. The engine speed-generating circuit 104 comprises a gate, the on and off of which are controlled at every 30° CA, and a counter for counting the number of pulses of the clock signal CLK of the clock-generating circuit 110 when the gate is open. Thus, the engine speed-generating circuit 104 generates a binary-code signal which is inversely proportional to the rotational speed $N_e$ of the engine 1.

The digital output signal from the idle position switch 5, is supplied directly to a predetermined position of the input interface port 105.

The digital output signal of the vehicle-speed sensor 9 is supplied via a wave-shaping circuit 106 and a vehicle speed-generating circuit 107 to predetermined positions of the input interface 105. The wave-shaping circuit 106 converts the output signal of the vehicle-speed sensor 9 into a rectangular signal which is transmitted to the vehicle speed-generating circuit 107. The vehicle speed-generating circuit 107 is comprised, for example, of a flip-flop, a gate, and a counter. That is, the flip-flop is set and reset alternately by the rectangular signal of the wave-shaping circuit 106 so that the gate is open only when the flip-flop is being set or reset. The counter counts the number of pulses of the clock signal CLK of the clock-generating circuit 110 via the open gate. Therefore, the counter generates a binary-code signal which has a value inversely proportional to the frequency of the rectangular signal, i.e., to the vehicle speed.

The output signal of the $O_2$ sensor 12 is supplied via an air-fuel ratio signal-generating circuit 108 to a predetermined position of the input interface 105. The air-fuel ratio signal-generating circuit 108 comprises a comparator for comparing the output of the $O_2$ sensor 12 with a reference voltage and a latch circuit for holding the output of the comparator. Thus, the air-fuel ratio signal-generating circuit 108 generates an air-fuel ratio signal having a value "1" or "0" depending upon whether the air-fuel mixture is on the lean side or on the rich side of the stoichiometric air-fuel ratio.

A read-only memory (ROM) 112 stores programs such as the main routine, the fuel-injection-amount calculating routine, the ignition-timing calculating routine, and the like.

The CPU 109 reads the fuel-injection-amount data out of the RAM 111 and transmits it to a predetermined position of an output interface 113. As a result, a driver circuit 114 activates the fuel injectors 14 for a time period corresponding to the fuel-injection amount at every predetermined operation cycle. For example, the driver circuit 114 comprises a register for receiving fuel-injection-amount data, a down counter for converting a digital signal indicative of the amount of fuel injected, calculated by the CPU 109, into a pulse signal having a pulse duration which determines the actual duration of the opening of the fuel injectors 14, and a power amplifier for actuating the fuel injectors 14. Thus, the amount of fuel corresponding to the computed pulse duration is injected into the combustion chamber of the engine 1.

Operation of the control circuit of FIG. 1 is explained with reference to the flow charts.

Figure 3:
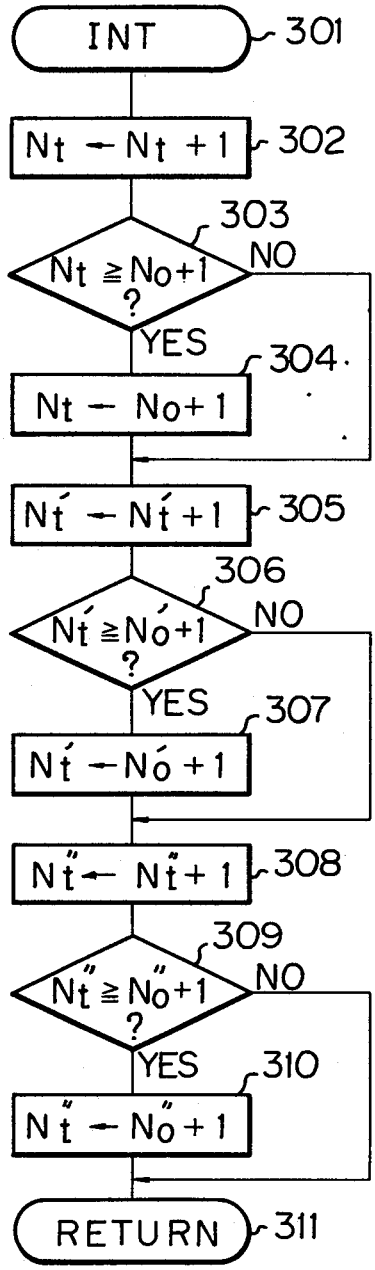
FIGS. 3 and 4 are flow charts illustrating the operation of the control circuit of FIG. 1.
Figure 4:
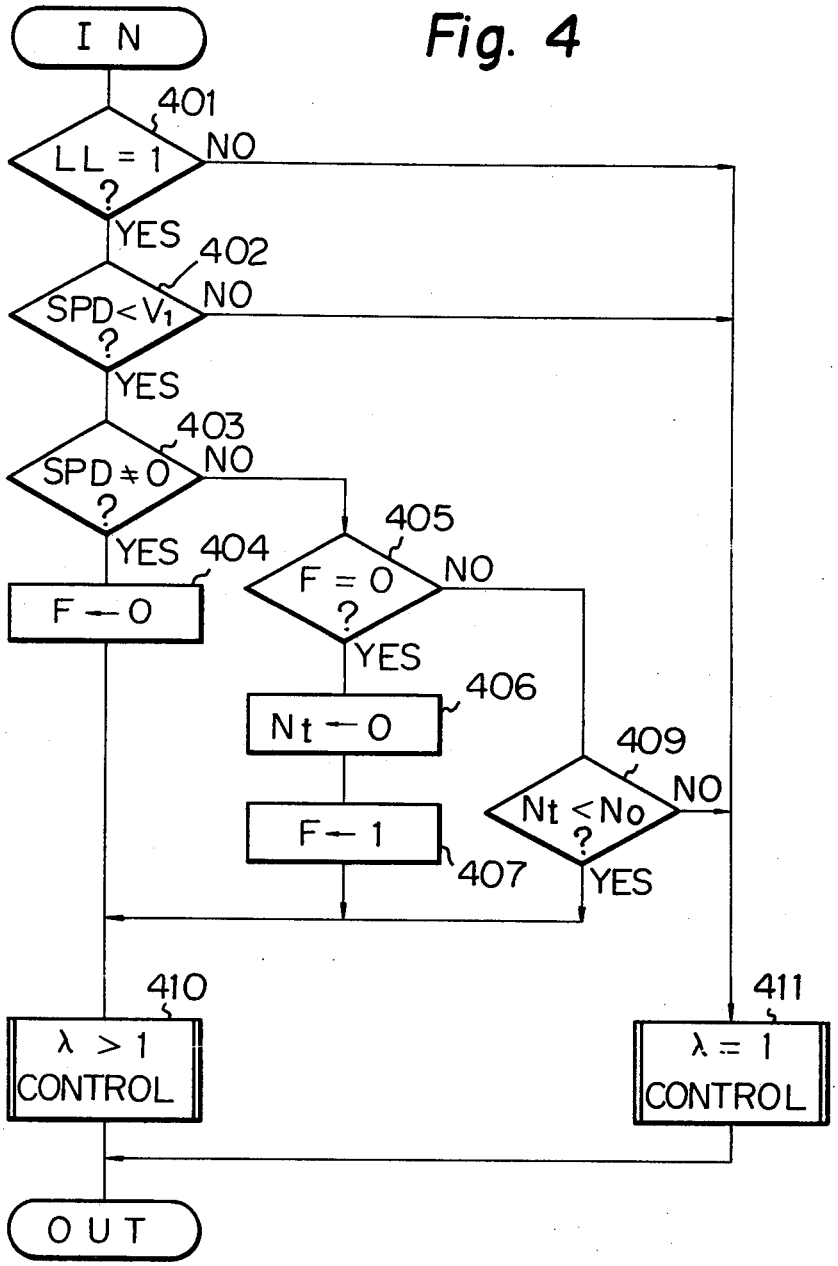
Figure 11:
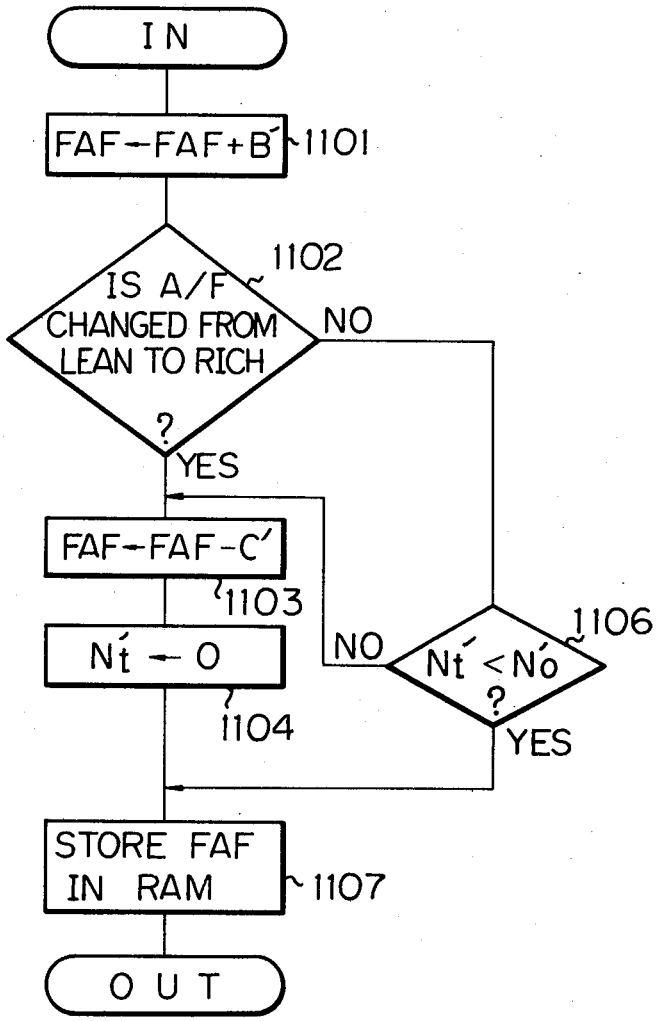
FIG. 11 is a third example of step 410 of FIG. 4.
Figure 13:
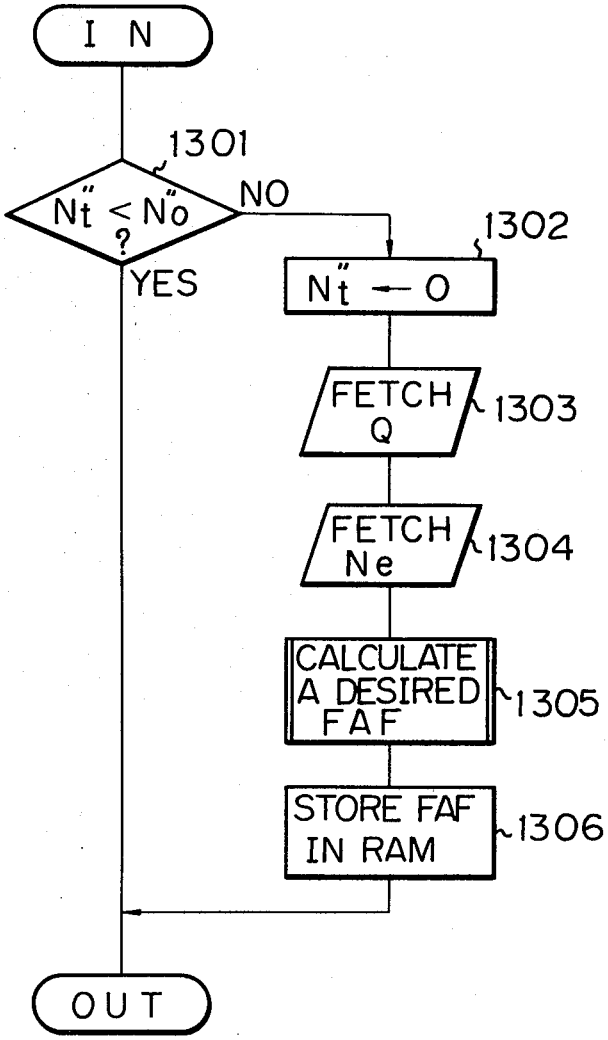
FIGS. 13 and 14 are fourth and fifth examples of step 410 of FIG. 4.

FIG. 3 is a flow chart of a time-interrupt routine carried out at every predetermined time period, such as 4 msec. That is, every 4 msec, control enters into interrupt step 301 and then is transferred to step 302. In step 302, the CPU 109 reads the timing counter data $N_t$ from a predetermined area of the RAM 111 and counts $N_t$, i.e., calculates $N_t$ $N_t+1$. The timing counter data $N_t$ is limited by steps 303 and 304, and, therefore, the maximum of the data $N_t$ is $N_0+1$. Then the data is again stored in the RAM 111. Similarly, at steps 305, 306, and 307, the CPU 109 counts another piece of timing counter data $N_t'$, and at steps 308, 309, and 310, the CPU 109 counts still another piece of timing counter data $N_t''$. The timer routine as illustrated in FIG. 3 is terminated by step 305. Note that the timing counter data $N_t$, $N_t'$, and $N_t''$ are used in other routines, as is illustrated in FIGS. 4, 11, and 13, respectively. Therefore, the timing counter data $N_t$, $N_t'$, and $N_t''$ are reset, i.e., cleared, in the corresponding routines.

In FIG. 4, which illustrates one part of the main routine, at step 401, the CPU 109 fetches the idle signal "LL" of the idle-position switch 5 and determines whether or not "LL"=1. If "LL"=0, i.e., if the engine 1 is not in an idle state, control is transferred to step 411, in which feedback of the air-fuel ratio is controlled so as to attain $\lambda=1$, which will be explained in more detail later. On the contrary, if "LL"=1, i.e., if the engine 1 is in an idle state, control is transferred to step 402.

At step 402, the CPU 109 fetches the vehicle-speed data SPD of the vehicle-speed sensor 9 and compares it with a predetermined value $V_1$. If the vehicle in which the engine 1 is disposed is in a usual running state, $SPD \geqq V_1$ and, accordingly, control is transferred to step 411. Contrary to the above, when the vehicle is decelerated so as to satisfy the condition $SPD < V_1$, control is transferred to step 403.

At step 403, the CPU 109 determines whether or not the vehicle-speed data SPD is equal to 0. At the beginning of the deceleration mode, SPD=0, and control is transferred to step 404, in which a flag F is cleared, and then is transferred to step 410, in which the air-fuel ratio is controlled so that the air-fuel mixture is on the lean side ($\lambda > 1$). Note that clearing of the flag F causes the timing counter value $N_t$ to be initialized after the vehicle is stopped.

That is, when the vehicle is stopped, control flow from step 403 to stop 404 is switched to control flow from step 403 to step 405, in which the CPU 109 determines whether or not F=0. In this state, since F=0, the timing counter value $N_t$ is reset to zero so as to restart the timer regarding the value $N_t$. Then control is transferred to step 407, in which the CPU 109 sets the flag F, and is further transferred to step 410, in which the air-fuel ratio is controlled so that the air-fuel mixture is on the lean side.

Since this main routine is repeated, control again enters into step 405. In this case, control flow from step 405 to step 406 is switched to control flow from step 405 to step 409 since F=0 previously set at step 404. At step 409, the CPU 109 determines whether or not $N_t < N_0$, where $N_0$ is the predetermined value. That is, the CPU 109 determines whether or not a predetermined time period ($=N_0 \times 4$ msec) elapses after the vehicle is stopped. When the elapsed time period does not reach the predetermined value, ($N_0 \times 4$ msec), control is transferred to step 410. Contrary to this, when the elapsed time period reaches the predetermined value, control is transferred to step 411. That is, control of the air-fuel ratio so that the air-fuel mixture is on the lean side ($\lambda > 1$) is stopped and the air-fuel ratio is controlled so that it is around the stoichiometric air-fuel ratio ($\lambda = 1$).

Thus, in the present invention, during the deceleration mode, in which "LL"=1 and $0 < SPD < V_1$, and for the predetermined time period ($N_0 \times 4$ msec) after the vehicle is stopped (SPD=0), the air-fuel ratio is controlled so that it is on the lean side.

Figure 5:
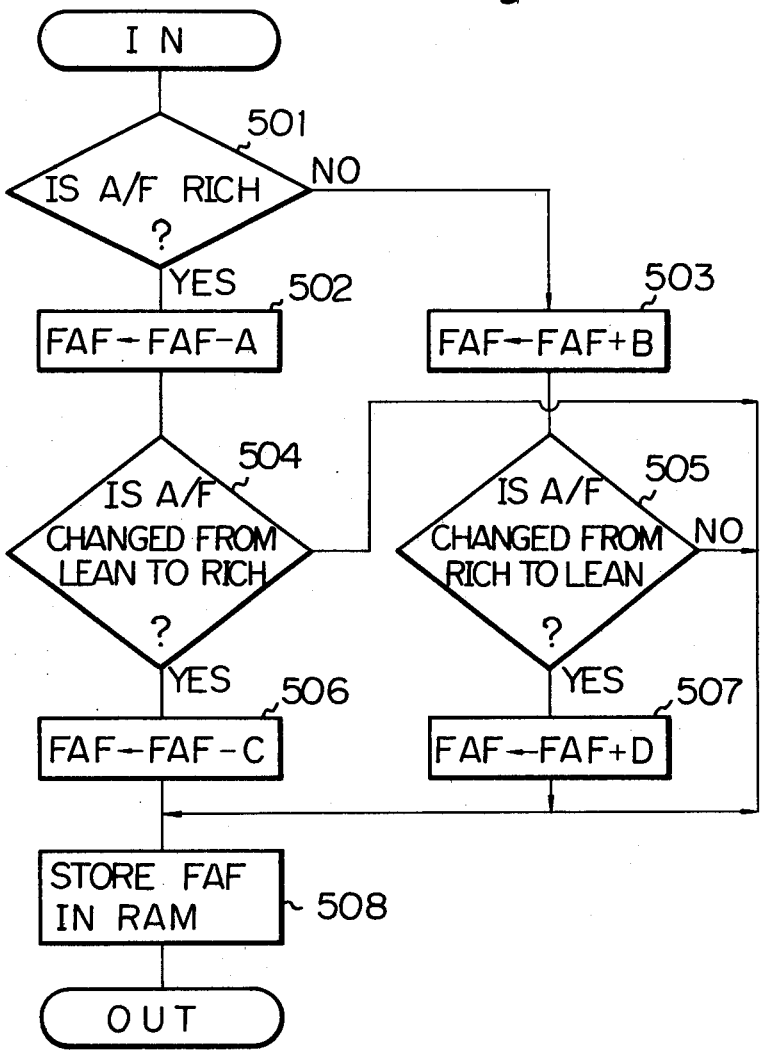
FIG. 5 is a detailed flow chart of step 411 of FIG. 4.

Control of the air-fuel ratio feedback to around the stoichiometric air-fuel ratio ($\lambda = 1$) at step 411 of FIG. 4 is explained in more detal with reference to FIG. 5, in which an air-fuel ratio correction factor FAF is calculated. First, control enters into step 501, in which the CPU 109 fetches the air-fuel signal of the air-fuel signal-generating circuit 108 and determines whether the air-fuel mixture of the engine 1 is rich or lean. If the air-fuel mixture is rich, control is transferred to step 502, in which FAF←FAF−A is calculated. Note that A is a definite value. Contrary to this, if the air-fuel mixture is lean, control is transferred to step 503, in which FAF←FAF+B is calculated. Note that B is also a definite value. During control of the air-fuel feedback, an operation as illustrated in step 502 or 503 is carried out. That is, according to this so-called integral control, the air-fuel ratio correction factor FAF is integrated with respect to time.

Control is transferred from step 502 to step 504, in which the CPU 109 determines whether or not the air-fuel mixture is changed from the rich side to lean side. That is, the CPU 109 determines whether or not the value of the air-fuel signal fetched in this cycle is the same as the value of the air-fuel signal fetched in the previous cycle which is stored in the RAM 111. If the two values are different from each other, control is transferred to step 506, in which FAF←FAF−C is calculated. In this case, the value C is considerably greater than the value A. Similarly, control is transferred from step 503 to step 505, in which the CPU 109 determines whether or not the air-fuel mixture is changed from the rich side to the lean side. If the determination at step 505 is YES, control is transferred to step 507, in which FAF←FAF+D is calculated. In this case, the value D is also considerably greater than the value B. When the determination at step 504 or 505 is NO, control is transferred to step 508. In addition, control in steps 506 and 507 flows to step 508. At step 508, the air-fuel ratio correction factor FAF is again stored in the RAM 111. Note that the operation at steps 506 and 507 is a so-called skip control operation for improving the converging characteristics of the air-fuel ratio correction factor FAF.

Figure 6:
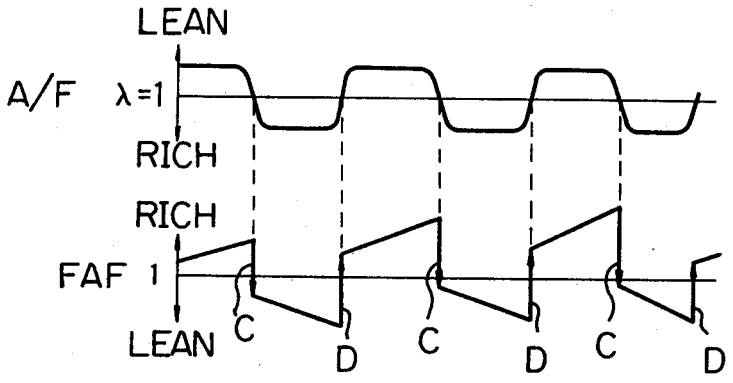
FIG. 6 is a diagram illustrating the characteristics of the flow chart of FIG. 5.
Figure 14:
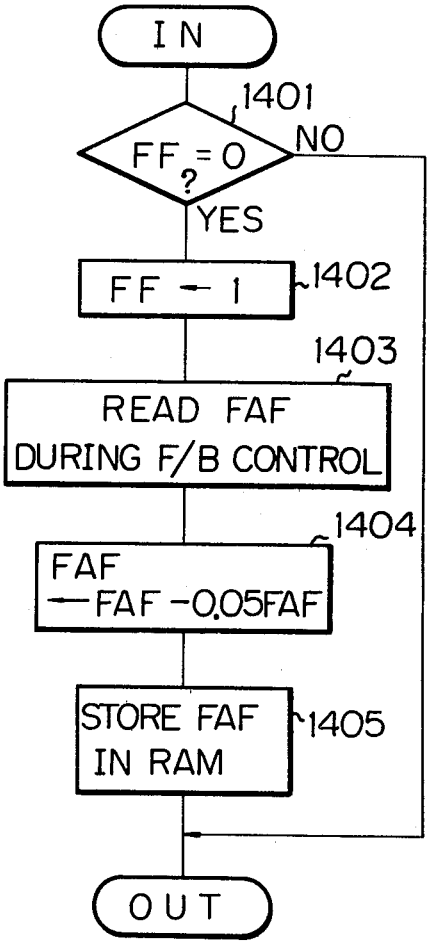

Referring to FIG. 6, which illustrates the characteristics of the air-fuel ratio A/F represented by the air ratio $\lambda$ and the air-fuel ratio correction factor FAF controlled by the air-fuel ratio control method as illustrated in FIG. 5, the control center of the air-fuel ratio is around $\lambda = 1$. Control of the air-fuel ratio so that the air-fuel mixture is on the lean side in step 410 of FIG. 4 is performed by means of the air-fuel ratio feedback control method, the open control method, and the hold control method. Control of the air-fuel ratio by of the means air-fuel ratio feedback control method so that the air-fuel mixture is on the lean side is illustrated in FIGS. 7, 9, and 11; control of the air-fuel ratio by means of the open control method so that the air-fuel mixture is on the lean side is illustrated in FIG. 13; and control of the air-fuel ratio by means of the hold control method so that the air-fuel mixture is on the lean side is illustrated in FIG. 14.

Figure 8:
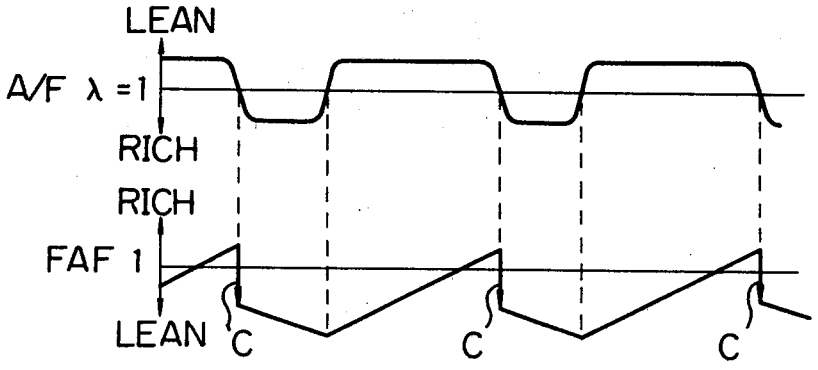
FIG. 8 is a diagram illustrating the characteristics of the flow chart of FIG. 7.
Figure 7:
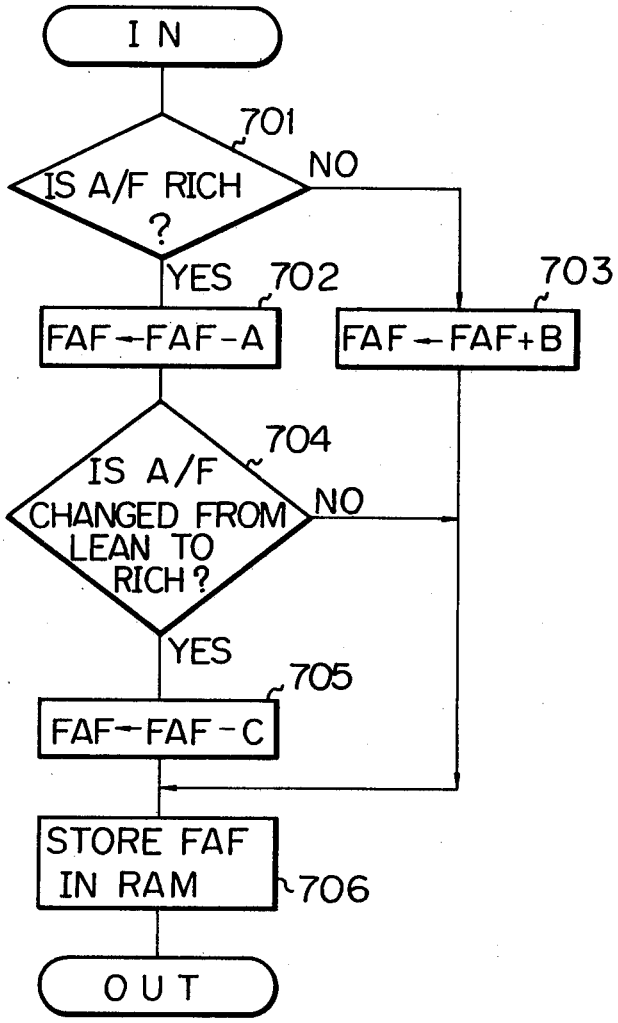
FIG. 7 is a first example of step 410 of FIG. 4.

In FIG. 7, steps 701, 702, 703, 704, 705, and 706 are the same as steps 501, 502, 503, 504, 506, and 508, respectively, of FIG. 5. That is, skip control corresponding to steps 505 and 507 and carried out when the air-fuel ratio signal is changed from rich to lean is omitted from FIG. 7. Therefore, as is illustrated in FIG. 8, the air-fuel ratio correction factor FAF is controlled so that the air-fuel mixture is on the lean side, with the result that the control center of the air-fuel ratio A/F is moved to $\lambda > 1$. Thus, since the air-fuel ratio is controlled so that the air-fuel mixture is on the lean side simultaneously with control of the feedback, the control center of the air-fuel ratio A/F is shifted only slightly from $\lambda = 1$.

Figure 9:
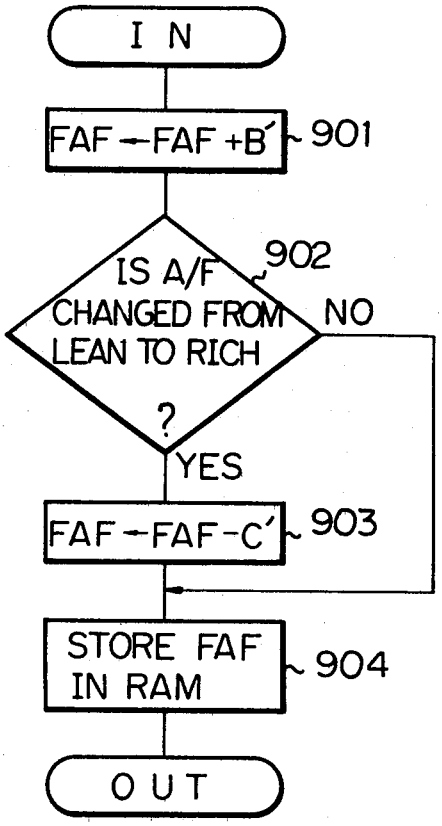
FIG. 9 is a second example of step 410 of FIG. 4.
Figure 10:
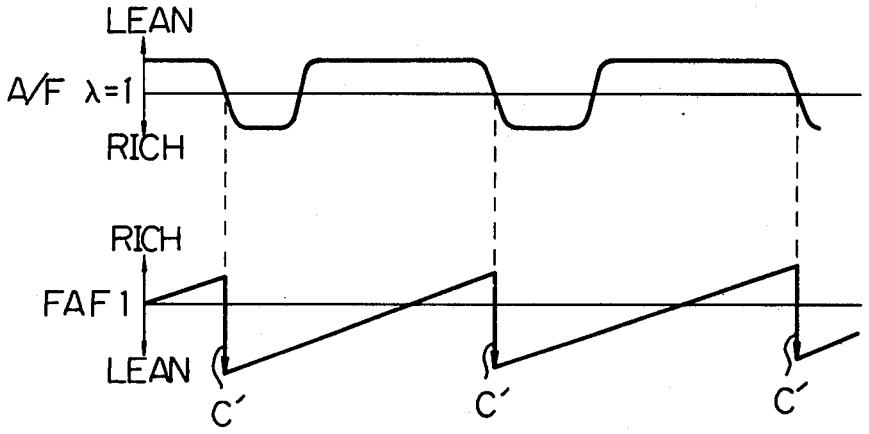
FIG. 10 is a diagram illustrating the characteristics of the flow chart of FIG. 9.

In FIG. 9, steps 901, 902, 903, and 904 are the same as steps 703, 704, 705, 706, respectively, of FIG. 7. That is, steps 701 and 702 of FIG. 7 are omitted from FIG. 9. Therefore, integral control in the fuel-increasing direction is carried out regardless of whether the air-fuel ratio signal indicates a rich or a lean air-fuel mixture. In this case, note that the value B′ of step 901 is less than the value B of step 503 of FIG. 5 or of step 703 of FIG. 7. Therefore, the integration control speed is less than the integral control speed in the control of the air-fuel feedback of step 411 as illustrated in FIG. 4. Further, the value C' of step 903 is greater than the value C of step 506 of FIG. 5 or of step 705 of FIG. 7. Therefore, as is illustrated in FIG. 10, the air-fuel ratio correction factor FAF is controlled so that the air-fuel mixture is on the lean side, with the result that the control center of the air-fuel ratio A/F satisfies $\lambda>1$ but is only slightly shifted from $\lambda=1$.

Figure 12:
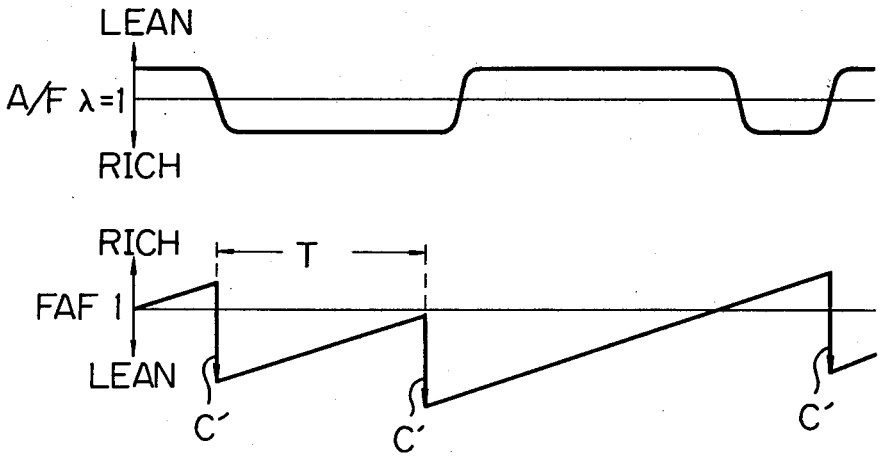
FIG. 12 is a diagram illustrating the characteristics of the flow chart of FIG. 11.

In FIG. 11, steps 1101, 1102, 1103, and 1107 are the same as steps 901, 902, 903, and 904, respectively, of FIG. 9. That is, steps 1104 and 1106 are added to FIG. 9. Therefore, due to the presence of steps 1104 and 1106, when the air-fuel mixture remains rich for a predetermined time period T ($=N_0'\times 4$ msec) after it is changed from lean to rich, i.e., after skip control, a skip control operation is again carried out. That is, as is illustrated in FIG. 12, when the air-fuel mixture remains rich for the time period T, the air-fuel ratio correction factor FAF is controlled so that the air-fuel mixture is much more on the lean side, with the result that the control center of the air-fuel ratio A/F is controlled to satisfy $\lambda>1$.

Control of the air-fuel ratio by means of the open control method so that the air-fuel mixtures is on the lean side is explained with reference to FIG. 13. Steps 1301 and 1302 determine whether or not the elapsed time is greater than a predetermined value ($=N_0''\times 4$ msec). Note that the predetermined value is set to be less than the fuel-injection cycle time. Therefore, every $N_0''\times 4$ msec, operations in steps 1303, 1304, 1505, and 1306 are carried out.

At step 1303, the CPU 109 fetches the intake-air amount Q of the airflow meter 3, and at step 1304, the CPU 109 fetches the engine speed $N_e$. Then at step 1305, the CPU 109 calculates a desired air-fuel ratio correction factor FAF from a two-dimensional map, stored in the ROM 112, to control the air-fuel ratio so that the air-fuel mixture is on the lean side depending upon the intake-air amount Q and the engine speed $N_e$. Then at step 1306, the CPU 109 stores the calculated air-fuel ratio correction factor FAF in the RAM 111. Thus, the desired air-fuel ratio correction factor FAF is determined depending upon the operating parameters of the engine 1, such as the intake-air amount Q and the engine speed $N_e$.

Control of the air-fuel ratio by means of the hold control method so that the air-fuel mixture is on the lean side is explained with reference to FIG. 14. In this hold control method, referring to FIG. 4, only when the air-fuel ratio feedback control at step 411 is stopped is the air-fuel ratio correction factor FAF compensated for toward a lean mixture. After that, the compensated factor FAF remains unchanged until air-fuel ratio control is restored at step 411. Here, assume that the flag FF used at steps 1401 and 1402 of FIG. 14 is reset, i.e., cleared, at step 411 of FIG. 4.

Therefore, when air-fuel ratio feedback control is stopped, i.e., when control is first transferred to step 410, control flows through steps 1401 and 1402 to step 1403, in which the CPU 109 reads the final air-fuel ratio correction factor FAF from the RAM 111. Then at step 1404, the CPU 109 calculates FAF←FAF−0.05FAF, i.e., decrease the factor FAF by 5%. At step 1405, the compensated factor FAF at step 1404 is again stored in the RAM 111.

Thus, after the air-fuel ratio correction factor FAF is $\pi$ calculated in the aforementioned routine, the fuel-injection amount is also calculated in the fuel-injection-amount calculating routine included in the same main routine. That is, the fuel-injection amount (time duration) $\pi$ is calculated as follows:

$$\pi=\pi_B\mathrm{FAF}(1+\mathrm{K})+\pi_V$$

where K is a transient correction factor and $\pi_V$ is an invalid time period. Then the calculated fuel-injection amount $\pi$ is stored in a predetermined area of the RAM 111. Further, in the interrupt routine for the fuel injection carried out at every 360° CA, the fuel-injection-amount data $\pi$ is transmitted from the RAM 111 via the output interface 113 to the driver circuit 114, with the result that the amount of fuel corresponding to the data $\pi$ is injected into the combustion chamber of the engine 1.

We claim:

1. A method for controlling the air-fuel ratio in an internal-combustion engine disposed in a vehicle, comprising the steps of:

detecting whether or not said engine is in an idle state;

detecting whether or not the speed of said vehicle is greater than a predetermined value;

detecting whether or not the speed of said vehicle is zero;

measuring an elapsed timer period, depending upon the speed of said vehicle being zero;

detecting a specific component concentration in the exhaust gas of said engine to generate an air-fuel ratio signal depending upon whether the air-fuel mixture of said engine is on the rich side or on the lean side;

controlling the feedback of the air-fuel ratio of said engine so that said air-fuel ratio is close to the stoichiometric air-fuel ratio by using said air-fuel ratio signal, depending upon said engine being in the idle state or upon the speed of said vehicle being equal to or greater than said predetermined value; and controlling the air-fuel ratio of said engine so that said air-fuel mixture is on the lean side, depending upon said engine being in the idle state and the speed of said vehicle being not zero and less than said predetermined value, or depending upon said engine being in the idle state and said elapsed time period being less than a predetermined time period.

2. A method as set forth in claim 1, wherein the step of controlling said air-fuel ratio so that the air-fuel mixture is on the lean side includes the steps of:

decreasing the air-fuel ratio correction factor depending upon whether or not said air-fuel ratio signal indicates that the air-fuel mixture is on the rich side;

increasing the air-fuel ratio correction factor depending upon whether or not said air-fuel ratio signal indicates that the air-fuel mixture is on the lean side;

decreasing rapidly the air-fuel ratio correction factor depending upon whether or not said air-fuel ratio signal indicates that the air-fuel mixture has changed from the lean side to the rich side; and calculating a fuel-injection amount depending on the air-fuel ratio correction factor.

3. A method as set forth in claim 1, wherein said step of controlling the air-fuel ratio so that the air-fuel mixture is on the lean side includes the steps of:

increasing the air-fuel ratio correction factor regardless of whether said air-fuel ratio signal indicates that the air-fuel mixture is on the lean side or on the rich side;

decreasing rapidly the air-fuel ratio correction factor depending upon whether or not said air-fuel mixture changes from the lean side to the rich side; and calculating a fuel-injection amount depending on the air-fuel ratio correction factor.

4. A method as set forth in claim 3, wherein said step of controlling the air-fuel ratio so that the air-fuel mixture is on the lean side further includes the steps of:

measuring an elapsed time period, depending upon whether or not said air-fuel mixture is on the rich side; and decreasing rapidly the air-fuel ratio correction factor depending upon said elapsed time period being greater than a predetermined time period.

5. A method as set forth in claim 1, wherein said step of controlling the air-fuel ratio so that the air-fuel mixture is on the lean side includes the steps of:

detecting the intake-air amount of said engine;

detecting the rotational speed of said engine;

calculating an air-fuel ratio correction factor depending upon the detected intake-air amount and the detected rotational speed; and calculating a fuel-injection amount depending on the caluculated air-fuel ratio correction factor.

6. A method as set forth in claim 1, wherein said step of controlling the air-fuel ratio so that the air-fuel mixture is on the lean side includes the steps of:

decreasing the air-fuel ratio correction factor calculated in said step of controlling the air-fuel ratio feedback by a predetermined value;

holding the decreased air-fuel ratio correction factor; and calculating a fuel-injection amount depending on the held air-fuel ratio correction factor.

7. An apparatus for controlling the air-fuel ratio in an internal-combustion engine disposed in a vehicle, comprising:

means for detecting whether or not said engine is in an idle state;

means for detecting whether or not the speed of said vehicle is greater than a predetermined value;

means for detecting whether or not the speed of said vehicle is zero;

means for measuring an elapsed time period, depending upon the speed of said vehicle being zero;

means for detecting a specific component concentration in the exhaust gas of said engine to generate an air-fuel ratio signal depending upon whether the air-fuel mixture of said engine is on the rich side or on the lean side;

means for controlling the feedback of the air-fuel ratio of said engine so that said air-fuel ratio is close to the stoichiometric air-fuel ratio by using said air-fuel ratio signal, depending upon said engine being in the idle state or upon the speed of said vehicle being equal to or greater than said predetermined value; and means for controlling the air-fuel ratio of said engine so that said air-fuel mixture is on the lean side, depending upon said engine being in the idle state and the speed of said vehicle being not zero and less than said predetermined value, or depending upon said engine being in the idle state and said elapsed time period being less than a predetermined time period.

8. An apparatus as set forth in claim 7, wherein said means for controlling the air-fuel ratio so that the air-fuel mixture is on the lean side includes:

means for decreasing the air-fuel ratio correction factor depending upon whether or not said air-fuel ratio signal indicates that the air-fuel mixture is on the rich side;

means for increasing the air-fuel ratio correction factor depending upon whether or not said air-fuel ratio signal indicates that the air-fuel mixture is on the lean side;

means for decreasing rapidly the air-fuel ratio correction factor depending upon whether or not said air-fuel ratio signal indicates that the air-fuel mixture has changed from the lean side to the rich side; and means for calculating a fuel-injection amount depending on the air-fuel ratio correction factor.

9. An apparatus as set forth in claim 7, wherein said means for controlling the air-fuel ratio so that the air-fuel mixture is on the lean side includes:

means for increasing the air-fuel ratio correction factor regardless of whether said air-fuel ratio signal indicates that the air-fuel mixture is on the lean side or on the rich side;

means for decreasing rapidly the air-fuel ratio correction factor depending upon whether or not said air-fuel mixture changes from the lean side to the rich side; and means for calculating a fuel-injection amount depending on the air-fuel ratio correction factor.

10. An apparatus as set forth in claim 9, wherein said means for controlling the air-fuel ratio so that the air-fuel mixture is on the lean side further includes:

means for measuring an elapsed time period, depending upon whether or not said air-fuel mixture is on the rich side; and means for decreasing rapidly the air-fuel ratio correction factor depending upon said elapsed time period being greater than a predetermined time period.

11. An apparatus as set forth in claim 7, wherein said means for controlling the air-fuel ratio so that the air-fuel mixture is on the lean side includes:

means for detecting the intake-air amount of said engine;

means for detecting the rotational speed of said engine;

means for calculating an air-fuel ratio correction factor depending upon the detected intake-air amount and the detected rotational speed; and means for calculating a fuel-injection amount depending on the calculated air-fuel ratio correction factor.

12. An apparatus as set forth in claim 7, wherein said means for controlling the air-fuel ratio so that the air fuel mixture is on the lean side includes:

means for decreasing the air-fuel ratio correction factor calculated by said means for controlling the air-fuel ratio feedback by a predetermined value;

means for holding the decreased air-fuel ratio correction factor; and means for calculating a fuel-injection amount depending on the held air-fuel ratio correction factor.

* * * * *